United States Patent [19]

Miyakawa

[11] Patent Number: 4,576,104

[45] Date of Patent: Mar. 18, 1986

[54] METHOD AND APPARATUS FOR ATTACHING FLY STRIPS TO A SLIDE FASTENER CHAIN

[75] Inventor: Kazuo Miyakawa, Marietta, Ga.

[73] Assignee: Yoshida Kogyo K. K., Tokyo, Japan

[21] Appl. No.: 650,803

[22] Filed: Sep. 14, 1984

[51] Int. Cl.[4] ..... D05B 19/00; D05B 3/22; D05B 27/16

[52] U.S. Cl. ..... 112/265.2; 112/121.11; 112/113; 112/305; 112/312

[58] Field of Search ..... 112/265.2, 121.11, 265.1, 112/113, 104, 312, 313, 305, 272

[56] References Cited

U.S. PATENT DOCUMENTS

| | | | |
|---|---|---|---|
| 3,570,104 | 3/1971 | Jensen . | |
| 4,066,028 | 1/1978 | Hornkohl | 112/121.11 X |
| 4,152,996 | 5/1979 | Van Amburg | 112/121.11 X |
| 4,421,044 | 12/1983 | Freermann et al. | 112/312 |
| 4,541,352 | 9/1985 | Boser et al. | 112/121.11 X |

*Primary Examiner*—H. Hampton Hunter

*Attorney, Agent, or Firm*—Hill, Van Santen, Steadman & Simpson

[57] ABSTRACT

An automated assembly produces a continuous, contiguous series of individual pieces sewn in a continuously operating sewing machine by conducting successive pieces to the sewing station through a feed station. The feed station may receive the pieces intermittently and irregularly but is equipped with guides and drives for accelerating each successive piece relative to the preceding pieces being sewn in the sewing machine to overtake any spatial gap between the trail end of the preceding piece and the lead end of the succeeding piece so that these ends abut prior to completion of the sewing of the preceding piece. The drives are continuously operating, yet overlapping of the end-to-end relation of the pieces and bunching or furling of the pieces due to this end-to-end abutment are prevented by guide surface confinement of the pieces in the feed station and a predetermined capability for slippage in the drive. The assembly has application in the making of closures for fly openings.

32 Claims, 10 Drawing Figures

METHOD AND APPARATUS FOR ATTACHING FLY STRIPS TO A SLIDE FASTENER CHAIN

CROSS-REFERENCE TO RELATED APPLICATION

This application relates to the subject matter discussed in my commonly assigned Ser. No. 643,543, filed Aug. 23, 1984, and entitled "Method And Apparatus For Attaching Fly Strips To A Slide Fastener Chain".

BACKGROUND OF THE INVENTION

The present invention relates to the production of a continuous, contiguous series of individual pieces in which the individual pieces can be intermittently and irregularly passed to a feed station for their delivery to a sewing machine. In particular, the invention concerns an arrangement for making a continuous, contiguous series of individual fly strips connected by a slide fastener chain in the manufacture of closures for fly openings.

The present invention represents a unique and novel answer to the need for an automated system in the sewing art which can translate intermittent and irregularly delivered individual pieces into an aligned series arranged in end-to-end relation for high-speed passage through a sewing station without interruption of the sewing process. The invention addresses this need in an economical and efficient way and, by enabling the individual pieces to be successively supplied and acted upon by a sewing machine without interruption, increases sewing production rate.

U.S. Pat. No. 3,750,104 discloses a system for automatically attaching a plurality of fly strip pieces one after another to a continuous slide fastener chain. There, the fly strips are fed to an intermittently operable sewing machine one after another by means of feed rollers in timed relation to the intermittent operation of the sewing machine. A continuous length of fastener chain is continuously fed to the sewing machine for joining fastener chain to the fly strip pieces. This intermittent operation of the sewing machine is controlled by a photoelectric cell detector at the sewing station. The detector detects the completion of sewing of one fly strip when the trailing end of a sewn fly strip piece passes it to produce a "stop" signal not only to terminate the operation of the sewing machine but also to energize the feed rollers. Subsequently, the detector detects the arrival of the next fly strip when the leading end of the next fly strip piece passes it to produce a "start" signal to initiate the operation of the sewing machine. Since the sewing operation is halted repeatedly with this system, there is considerable waste of sewing machine on-time and only a limited rate of production of the trouser closures can be achieved.

The present invention is a significant advance and improvement in efficiency and economy over the prior art.

SUMMARY OF THE INVENTION

Individual pieces to be sewn are successively transfered through an inventive feed station to a sewing station in which a sewing machine having its own feed dog is operating. Regardless of the lengths of the pieces (which could even vary) or the reasonable irregularity with which the pieces are supplied to the feed station, the feed station causes successive pieces to become aligned and made into a continuous series in end-to-end abutting relation for sewing in the sewing station without interrupting operation of the sewing machine. The sewing machine may be continuously supplied with a continuous length material for sewing onto the series of individual pieces received from the feed station and joining together the individual pieces.

The feed station comprises a series of drive and guide roller pairs, each defining a nip relationship therebetween through which pass the successive individual pieces supplied to the feed station. The drive roller speed in the upstream nip is greatest and becomes progressively reduced in each further downstream nip, but drive roller speed in each nip is greater than the rate of the feed of the sewing machine. Each successive piece entering the feed station is accelerated relative to the preceding piece being sewn in the sewing station such that each succeeding piece overtakes any spatial gap between its leading end and the trailing end of the preceding piece prior to completion of the sewing operation on the preceding piece.

The guide rollers are lightly biased against their respective drive rollers and mounted in a housing having a guide surface wall defining a predetermined clearance space across from the support surface over which the individual pieces are transfered by the drive rollers in the feed station. By virtue of this arrangement, each succeeding piece is able to abut in end-to-end relation with the preceding piece being sewn, and is prevented from overlapping the trailing end of the preceding piece or from becoming furled or bunched at the leading end of the succeeding piece. The guide rollers are also rotated about axes angled relative to the rotational axes of the drive rollers for steering the pieces as they are transfered through the feed station along a vertical guide edge for alignment.

In one application of the invention, successive fly strips are able to be continuously sewn in a continuous series to an endless slide fastener chain in a sewing machine station. The fly strips may be irregularly and intermittently supplied to the feed station manually or via some automated delivery device, while the sewing machine is continuously operating and continuously supplied with fastener chain for sewing onto the series of end-to-end abutting fly strips delivered to the sewing machine from the feed station.

The invention could also have similar application with other types of individual piecework to be sewn, individually or together with another piece such as a continuous length material. The benefits to sewing operation efficiency and improved production due to the invention are not limited to the preferred embodiment use with fly strips.

Other features, objects, and advantages to the present invention will become apparent to those skilled in the art from the detailed description below of a preferred embodiment.

DESCRIPTION OF THE PREFERRED EMBODIMENT

The preferred embodiment application of the present invention is the manufacture of closures for fly openings whereby a series of individual fly strip pieces joined together by a continuous length slide fastener chain is made at a high rate of production, not heretofore possible, using a continuously operating sewing machine.

Figure 1:
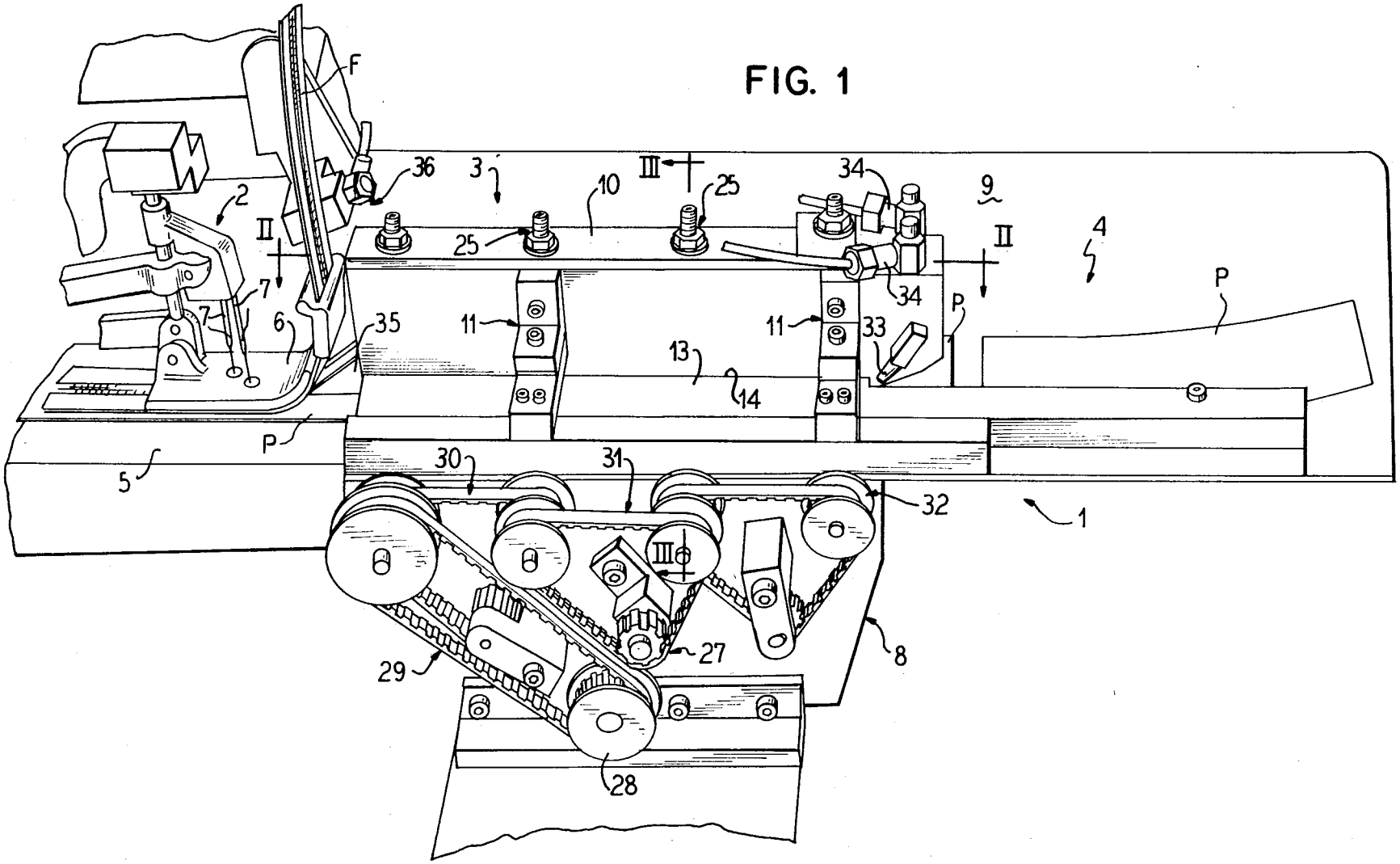
FIG. 1 is a side elevational view of a fly strip attaching assembly embodying the present invention.

FIG. 1 shows an automated assembly 1 for attaching a succession of fly strip pieces P to a continuous slide fastener chain F continuously without interruption and in an efficient manner whereby the fly strips P are joined together by the fastener chain F in abutting end-to-end relation. The assembly 1 generally comprises a sewing machine station 2, a feed station 3 for automatically delivering successive fly strip pieces continuously to the sewing machine, and a supply station area 4 where fly strip pieces are consecutively passed to the upstream end of the feed station 3 in what may be an intermittent and irregular fashion.

The sewing machine 2 may be a conventional type on the market. It includes a support table 5 for supporting thereover each successive fly strip P to be sewn, a pressure foot 6, a pair of needles 7 for sewing the fly strips P to the fastener chain F, and a typical feed dog device (not shown) for conducting piecework through the sewing machine operation. The fastener chain F is continuously supplied from a non-illustrated reel, support on an upper portion of the sewing machine 2, to the sewing needles 7 through the space between the support table 5 and the pressure foot 6. The details of the sewing machine 2 itself are not pertinent here, and its detailed description is omitted for clarity.

The feed station 3 is mounted on a framework 8 having a support table surface 9 immediately upstream of the sewing machine 2 and will be described with reference to FIGS. 1–3. The successive fly strips P being delivered by the feed station 3 to the sewing machine pass over the table surface 9 beneath a housing 10 which extends longitudinally with the sewing machine operation and the flow path of the pieces P thereto.

The housing 10 is vertically upstanding from the table surface 9 and defines an interior containment space which opens downwardly facing the table surface. The housing 10 is suitably supported on bracket means 11 such that its rail-like lower edge wall surfaces 12 overlie the table surface 9 by a predetermined clearance space C. For reasons described later, this clearance space distance closely approximates the thickness of the piece P passing through the feed station 3. For example, for a fly strip having a 0.8 mm thickness, the clearance space C is preferably about 1–1.2 mm. Also upstanding from the table surface 9 to one side of the housing 10 and extending along the clearance space C is a wall piece 13 having a guide edge surface 14. The guide edge 14 runs parallel to the housing substantially the full length of the housing and preferably an appreciable distance into the supply station area 4.

For conveying the successive fly pieces P through the feed station 3, the housing contains a series of idler support or guide rollers 15–18 which extend into the clearance space C from above and are respectively paired with driven rollers 19–22 extending into the clearance space from below through suitable openings in the table surface 9 to form consecutive drive nips through which the fly strips P are conducted.

Each idler support roller is mounted for rotation at the lower end of axle support bars 23. The support bars 23 are mounted for slidable movement in vertically extending slots in the housing 10. Biasing means, shown here in the form of coil springs 24 having adjustability in the form of a thread bolt engagement 25 extending upward from the top wall of the housing 10, apply a light resilient downward bias on the support bars 23 and hence also the support rollers 15–18.

The driven rollers 19–22 are each disposed for rotation on ends of respective axles 26 A–D. The axles 26 A–D are suitably journaled in the framework 8 beneath the table surface 9 along parallel axes laterally perpendicular to the longitudinal extension of the housing 10 and the flow path of successive fly pieces P through the feed station 3. As shown in FIG. 1, a rotary drive transmission system 27 is connected to the outer free ends of the driven roller axles 26 A–D to effect different speed rotation of the driven rollers 19–22 and continuous operation of the feed station's drive means (rollers 15–22). In illustration, a rotary motor (not shown) turns a drive wheel 28. The drive wheel 28 operates a first belt and pulley transmission 29 to turn axle 26A for rotating driven roller 22. A second belt and pulley transmission 30 imparts relatively faster rotational speed to axle 26B turning driven roller 21. A third belt and pulley transmission 31 engages axle 26C to rotate roller 20 at a still faster speed; and a final belt and pulley transmission 32 imparts the relatively greatest rotational speed to axle 26D turning the upstream-most driven roller 19 in the feed station.

Thus, in accordance with the invention, the rotational speeds of the driven rollers 19–22 in the feed station 3 are progressively slower in each further downstream drive nip in the feed station; however, the rates of speed of all driven rollers are always greater than the rate of feed of the sewing machine 2. For example, the following speed rates have been found to afford effective operation of the assembly for handling the sewing of successive fly strip pieces P to a continuous fastener chain F: the driven roller 19 is at a highest rate of speed which is 40% faster than the rate of speed of the sewing machine feed and the driven rollers 20, 21, and 22 are at respective rates of speed 20%, 10%, and 5% faster than the sewing machine feed.

Figure 2:
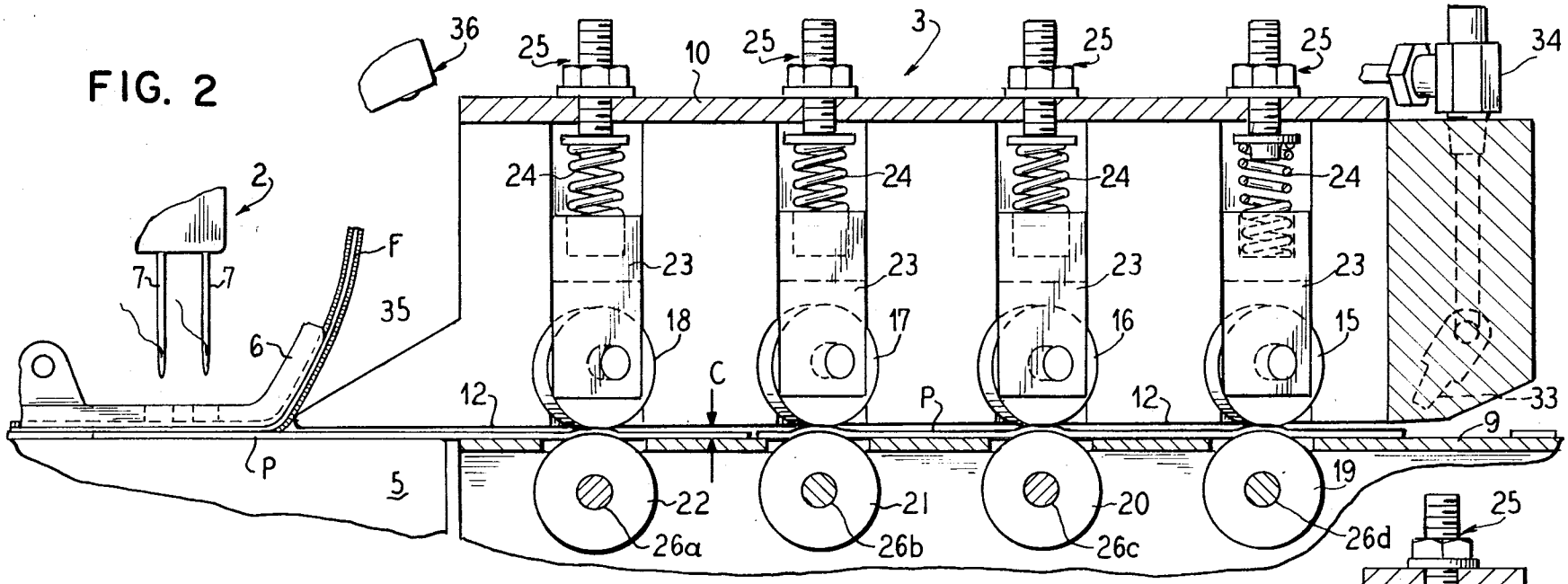
FIG. 2 is a cross-sectional view taken along the lines II—II of FIG. 1.
Figure 3:
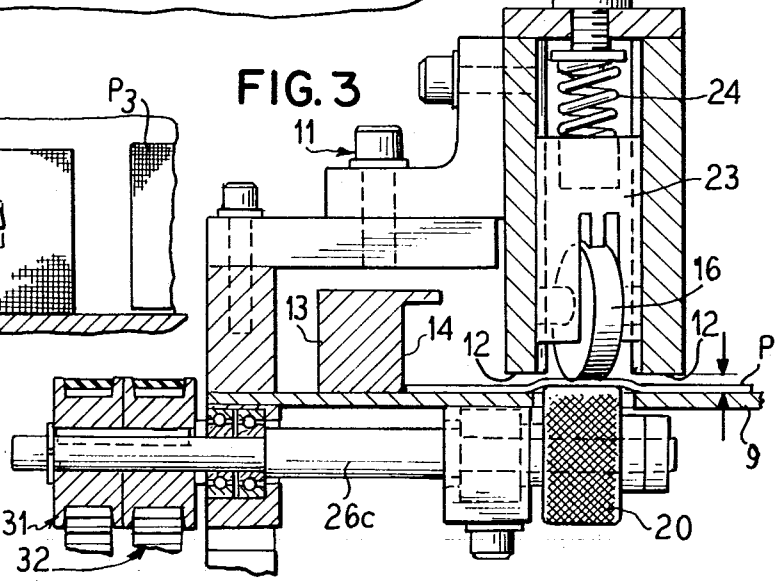
FIG. 3 is a cross-sectional view taken along the lines III—III of FIG. 1.

As shown in FIGS. 2–3, the axles for the idler support rollers 15–18 define parallel rotational axes for these rollers which are laterally angled offset from the rotational axes of the driven rollers 19–22. The downstream facing ends of the support rollers 15–18 are all directed partially sideways (relative to the driven roller dispositions) toward the guide edge 14 for, as further described below, effectively steering a common side edge of each successive fly strip piece P against and along the guide edge 14, relatively aligning succeeding and preceding pieces during conduction through the feed station 3 and at the sewing machine.

At the supply station area 4, individual pieces P are passed (preferably somewhat along the guide edge 14) into the clearance space C of the feed station 3 for initial conveying engagement with the upstream-most and highest speed drive nip formed by rollers 15 and 19. As the detailed discussion of the operation of the inventive assembly 1 set forth below discloses, regardless of the lengths of the pieces P (which could even vary) or the reasonable irregularity with which the pieces are supplied into the feed station 3, each successive piece entering the feed station is accelerated relative to the preceding piece being sewn in the sewing machine 2 such that each successive piece overtakes any spatial gap between its leading end and the trailing end of the preceding piece prior to completion of the sewing operation on the preceding piece. Passage of individual pieces P to the feed station 3 may be done manually, as illustrated here, or come from an automated conveyor arrangement.

In accordance with the preferred embodiment, operation of the inventive assembly 1 is enhanced by the following features. At the upstream end of the housing 10, there is provided a pair of air jet nozzles 33 to which a continuous supply of pressurized air is supplied by suitable hose connections 34 for issuing a pressure angled downward and in the axial direction of movement of fly strip pieces P through the feed station 3. This enables holddown of the lead edge of each piece for easy entry into the clearance space C and assists movement of each piece into the feed station. At the downstream end of the housing 10, an axial extension 35 of the lower edge surfaces 12 is provided substantially right up to the pressure foot plate 6 in the sewing machine 2. There may also be provided a sensor system, indicated here by photodetector 36, immediately upstream of the sewing machine 2 to effect shut off of the sewing machine 2 operation should a spatial gap appear following the trailing end of a piece P being sewn (such as if supply of pieces to the feed station has been halted or unduly delayed) to conserve fastener chain F and sewing machine operation. A suitable start switch, such as a foot pedal, can be used to reactivate the sewing machine when renewed sewing operation is desired.

Figure 5:
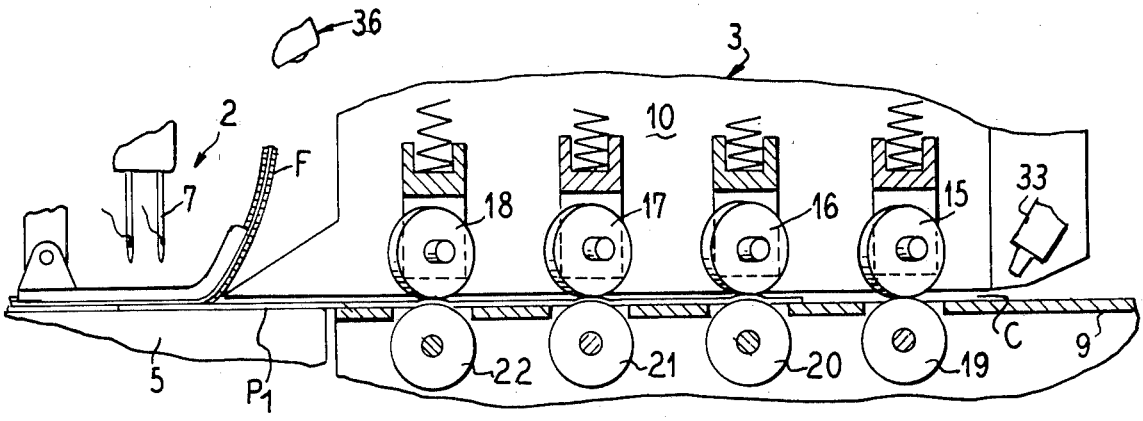
FIGS. 5–10 are partly schematic cross-sectional side elevational views of the sequential operation of the assembly of FIG. 1.

Operation of the automated assembly 1 is shown in sequence in FIGS. 5–10. As shown in FIG. 5, the sewing machine 2 is operating and sewing together the continuous length fastener chain F and the leading end of a fly strip piece $P_1$ being delivered from the feed station 3. As the fly strip piece is being sewn, its rate of movement is that of the rate of feed of the sewing machine. This is so, despite the fact that the driven rollers (20–22) of the drive nips in which the piece being sewn is still disposed have rates of speed greater than the feed of the sewing machine, since the upper and lower surfaces of the piece are closely confined in the clearance space C against bunching or furling by the guide surfaces 12 and 9 and the relatively weak biasing force on the support rollers (16–18) enables the driven rollers to slip easily beneath the piece in this situation.

Figure 6:
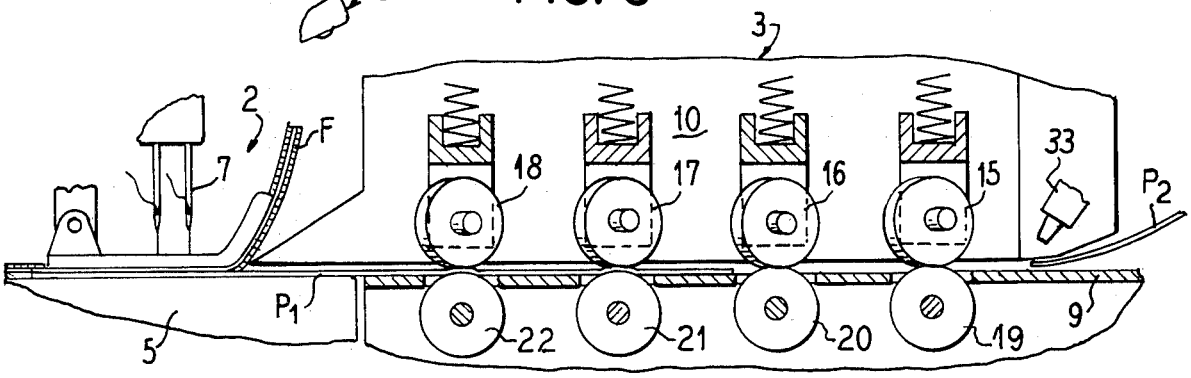
Figure 7:
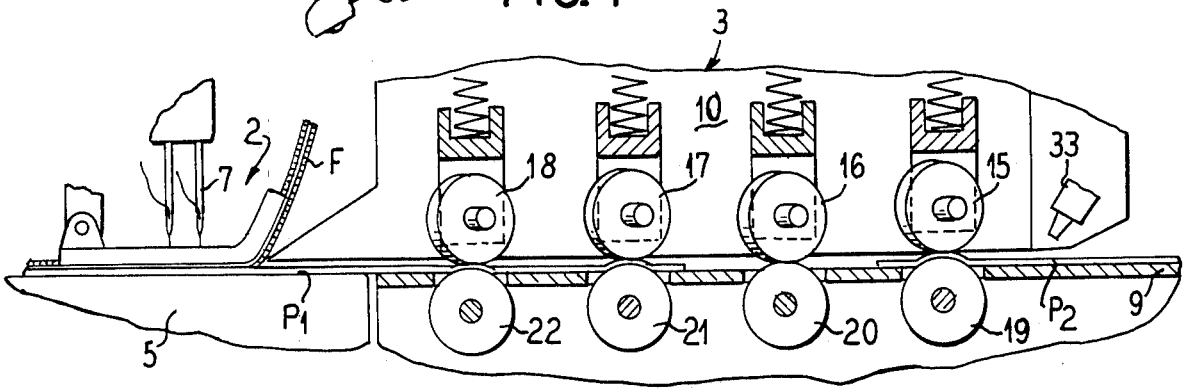

FIG. 6 illustrates a succeeding fly strip piece $P_2$ being passed into the upstream end of the feed station 3 for delivery to the sewing station 2. The pressure from the air jets 33 serve to hold the lead end of the succeeding piece $P_2$ down against the table surface 9 to facilitate its entry into the clearance space C. When the lead end of the succeeding piece $P_2$ reaches the drive nip formed by the support and driven paired rollers 15 and 19, furthest upstream in the feed station 3, the succeeding piece is positively engaged and most quickly accelerated toward the trailing end of the preceding piece $P_1$ being sewn, as shown in FIG. 7.

Figure 8:
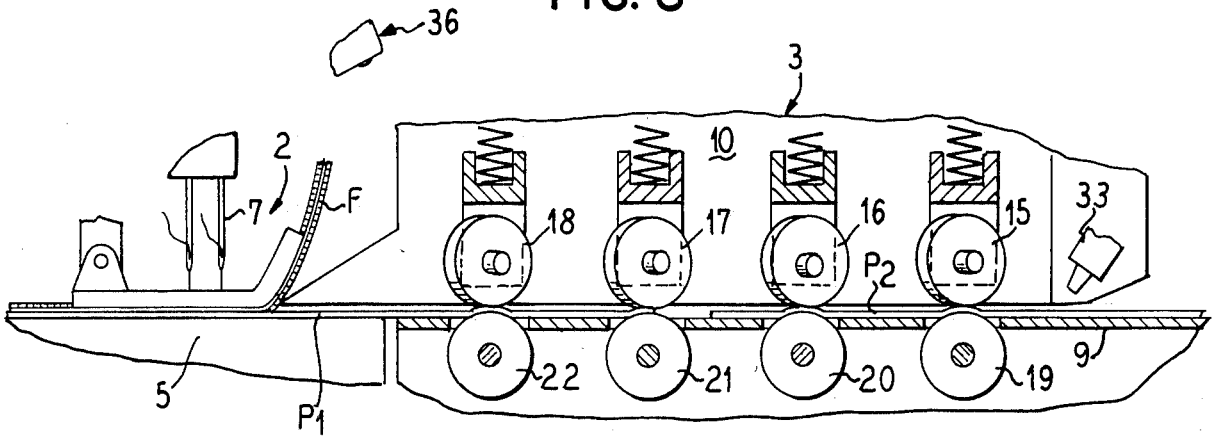
Figure 9:
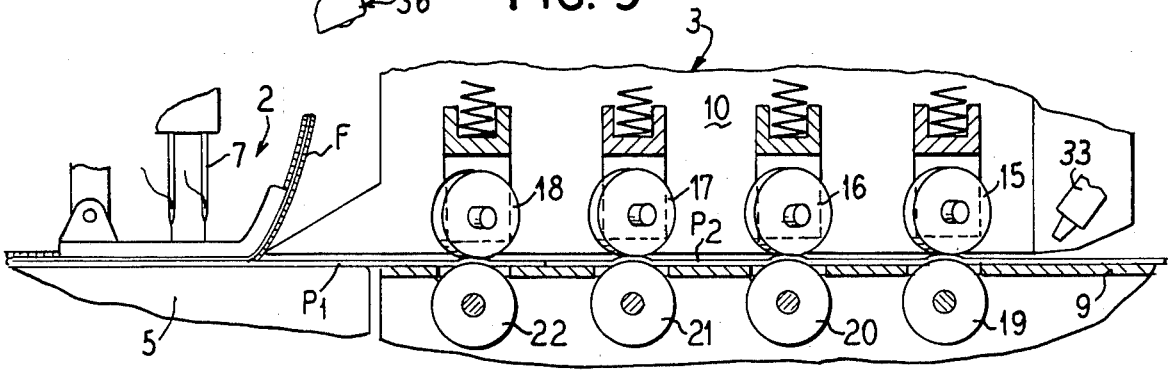

The succeeding piece $P_2$ continues to be consecutively positively engaged in further downstream drive nips for conveyance toward the trailing end of the preceding piece $P_1$ (being sewn) at speeds designed to overtake the spatial gap between these successive piece ends, as shown in FIGS. 8 and 9, until the succeeding piece's lead end abuts the preceding piece's trailing end. Each time the succeeding piece's leading end reaches a further downstream drive nip prior to abutting with the trailing end of the preceding piece $P_1$, travel speed of the succeeding piece $P_2$ is relatively slowed to the lower rate of speed of that further downstream nip's driven roller. Bunching or furling of the upstream portions of the succeeding piece acted upon by the faster driven rolers is prevented again by the close confinement of piece in the clearance space C and the capability of the drive rollers to slip easily beneath the piece when its leading end travel rate has been relatively reduced.

Figure 4:
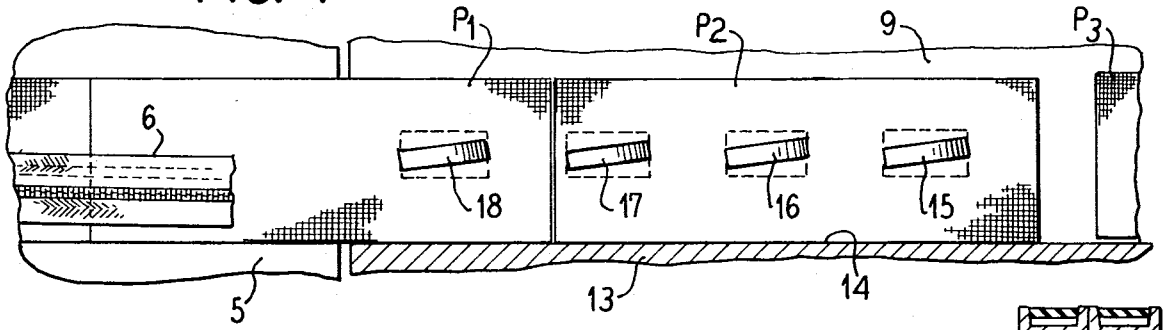
FIG. 4 is a schematic plan view of a succession of fly strips passing through the assembly of FIG. 1.

As indicated in FIG. 4, in addition to being indexed forwardly through the feed station 3 by the drive nips, the succeeding piece $P_2$ is also simultaneously steered laterally by the slant disposition of the idler support rollers so that a side edge of the piece is aligned for movement against and along the guide edge wall 14. Such alignment against the guide edge 14 has already occurred with the preceding piece $P_1$ and occurs with each successive piece transported by the feed station 3 so that the continuous series of pieces placed in end-to-end relation by the assembly 1 are longitudinally aligned with one another for easier subsequent handling.

Figure 10:
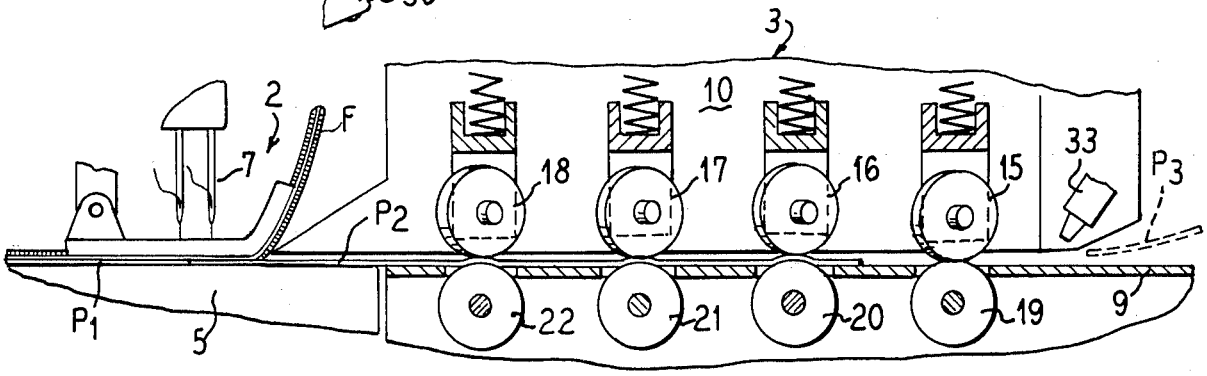

The leading end of the succeeding piece $P_2$ reaches the trailing end of the preceding piece $P_1$ prior to completion of the sewing operation on the preceding piece, as shown by FIG. 9. As the succeeding piece $P_2$ abuts the preceding piece $P_1$ in end-to-end relation, the rate of travel of the succeeding piece matches that of the preceding piece being sewn at the rate of feed of the sewing machine and no bunching of or overlapping by the succeeding piece occurs. As the preceding piece $P_1$ is indexed forward by the sewing machine feed, the succeeding piece $P_2$ is also indexed forward by the drive nip engagement of this piece in the feed station 3 by virtue of the release of resistance against forward movement on the succeeding piece until abutment again. Eventually, as indicated by FIG. 10, conveyance of the succeeding piece $P_2$ is taken up by the sewing machine feed just prior to completion of sewing of the preceding piece $P_1$. Thus, abutting end-to-end relation of the preceding and succeeding pieces is maintained through completion of the sewing of the preceding piece $P_1$, whereupon sewing of the leading end of the succeeding piece $P_2$ commences and the operation repeats as a futher succeeding piece $P_3$ is passed to the feed station 3 as indicated by FIG. 10. Thus, a continuous, contiguous series of aligned fly strip pieces P joined together by continuous fastener chain F is produced, regardless of reasonable irregularities with which consecutive fly strip pieces are passed to the feed station and unaffected by the length of the pieces.

Preferably in operation of the assembly 1, the drive for the driven rollers 19–22 in the feed station is always continuously operating. The sewing machine 2 is also expected to be continuously operating, except if selectively controllably shut down for brief periods upon sensing the absense of an abutting succeeding piece at the end of the sewing operation on a preceding piece.

Although various minor modifications may be suggested by those versed in the art, it should be understood that I wish to embody within the scope of the patent warranted hereon all such modifications as reasonably and properly come within the scope of my contribution to the art.

I claim as my invention:

1. An automated method of transfering successive individual pieces to a sewing machine to form a continuous series of said pieces in end-to-end relation comprising:

sewing a preceding piece in said sewing machine with a leading end of said preceding piece sewn first and a trailing end of said preceding piece sewn last, continuously operating a drive means for driving a succeeding piece toward said sewing machine at a speed substantially faster than the rate of feed of said sewing machine until a leading end of said succeeding piece abuts the trailing end of said preceding piece as said preceding piece is being sewn, and supporting said succeeding piece during said driving such that the leading end of said succeeding piece does not overlap or bunch at said preceding piece trailing end upon abutting despite continuous operation of said drive means.

2. The method of claim 1, further comprising:

aligning said succeeding piece behind said preceding piece during said driving.

3. The method of claim 1, further comprising:

shutting off said sewing machine in response to detecting a spatial gap at said sewing machine following the trailing end of said preceding piece being sewn in the otherwise continuous operation of said sewing machine.

4. The method of claim 1, wherein said driving is effected by a series of opposed driven roller and idle support roller pairs defining therebetween a nip relation through which each said succeeding piece consecutively passes and said support rollers are lightly biased against said respective driven rollers to permit slippage of driven rollers engagement of said succeeding piece.

5. The method of claim 4, wherein said succeeding piece is driven through a clearance space between opposed surfaces, said clearance space being sized to prevent bunching of said succeeding piece when it abuts the preceding piece's trailing end.

6. The method of claim 4, wherein the rates of speed of said drive rollers are progressively slower in each further downstream nip, but always greater than the rate of feed of said sewing machine.

7. The method of claim 1, wherein said succeeding piece is driven through a clearance space between opposed surfaces, said clearance space being sized to prevent bunching of said succeeding piece when it abuts the preceding pieces' trailing end.

8. The method of claim 1, further comprising:

continuously delivering a continuous length material to said sewing machine for being sewn onto said successive pieces.

9. Apparatus for automatically transfering successive individual pieces to a sewing machine for sewing a continuous series of said pieces in end-to-end relation, comprising means for commencing sewing of a preceding piece in said sewing machine, a feed station upstream of said sewing machine for delivering a succeeding piece toward said sewing machine, said feed station having a continuously operating drive means for conducting said succeeding piece through said feed station at a speed substantially faster than the rate of feed of said sewing machine until a leading end of said succeeding piece abuts the trailing end of said preceding piece as said preceding piece is being sewn and having a guide means for guiding said succeeding piece through said feed station, and means for passing successive pieces consecutively to said feed station, such that the leading end of said succeeding piece does not overlap or bunch at said preceding piece trailing end upon abutting despite continuous operation of said drive means.

10. The apparatus of claim 9, further comprising means for shutting off said sewing machine in response to detecting a spatial gap at said sewing machine following the trailing end of said preceding piece being sewn.

11. The apparatus of claim 9, wherein said drive means comprises a series of driven conveyor means for consecutively moving said succeeding piece through said feed station, the rates of speed of said conveyor means being progressively slower at each further downstream conveyor means but always greater than the rate of feed of said sewing machine.

12. The apparatus of claim 11, wherein the rate of speed of said upstream-most conveyor means is about 40% greater than the rate of feed of said sewing machine.

13. The apparatus of claim 9, wherein said guide means comprises an edge wall against and along which a common side of each succeeding piece is moved by said drive means for aligning said successive pieces during conduction through said feed station.

14. The apparatus of claim 9, wherein said drive means comprises a series of opposed driven roller and idle support roller pairs defining therebetween a nip relation through which each said succeeding piece consecutively passes and said support rollers being lightly biased against said respective driven rollers to permit slippage of driven roller engagement of said succeeding piece.

15. The apparatus of claim 14, wherein said guide means comprises a pair of opposed surfaces defining a clearance space therebetween through which said succeeding piece is conducted by said driven and support roller nips, said clearance space being sized to prevent bunching of said succeeding piece when it abuts the preceding piece's trailing end.

16. The apparatus of claim 15, wherein said support rollers are rotated about parallel axes angled offset relative to parallel rotational axes of said driven rollers and said guide means includes an edge wall adjacent said clearance space against and along which a common side of each succeeding piece is steered by said support rollers for aligning said successive pieces during conduction through said feed station.

17. The apparatus of claim 14, wherein said support rollers are rotated about parallel axes angled offset relative to parallel rotational axes of said driven rollers and said guide means includes an edge wall adjacent said clearance space against and along which a common side of each succeeding piece is steered by said support rollers for aligning said successive pieces during conduction through said feed station.

18. The apparatus of claim 14, wherein the rates of speed of said driven rollers are progressively slower in each further downstream nip, but always greater than the rate of feed of said sewing machine.

19. The apparatus of claim 18, wherein the rate of speed of said upstream-most driven roller is about 40% greater than the rate of feed of said sewing machine.

20. The apparatus of claim 9, further comprising means for delivering a continuous length material to said sewing machine for being sewn onto said successive pieces.

21. A method of attaching successive fly strips to a continuous slide fastener chain whereby the fly strips are formed into a continuous series in end-to-end relation, comprising:

sewing a preceding fly strip in a sewing machine with a leading end of said preceding piece sewn first and a trailing end of said preceding piece sewn last, continuously operating a drive means for driving a succeeding fly strip towards said sewing machine at a speed substantially faster than the rate of feed of said sewing machine until a leading end of said succeeding fly strip abuts the trailing end of said preceding fly strip as said preceding fly strip is being sewn, supporting said succeeding fly strip during said driving such that the leading end of said succeeding fly strip does not overlap or bunch at said preceding fly strip trailing end upon abutting despite continuous operation of said drive means, and continuously delivering said slide fastener chain to said sewing machine for sewing onto said fly strips.

22. The method of claim 21, further comprising:

aligning said succeeding fly strip behind said preceding fly strip during said driving.

23. The method of claim 21, further comprising:

shutting off said sewing machine in response to detecting a spatial gap at said sewing machine following the trailing end of said preceding fly strip being sewn in the otherwise continuous operation of said sewing machine.

24. The method of claim 21, wherein said driving is effected by a series of opposed driven roller and idle support roller pairs defining therebetween a nip relation through which each said succeeding fly strip consecutively passes and said support rollers are lightly biased against said respective drive rollers to permit slippage of driven roller engagement of said succeeding fly strip.

25. The method of claim 24, wherein said succeeding fly strip is driven through a clearance space between opposed surfaces, said clearance space being sized to prevent bunching of said succeeding fly strip when it abuts the preceding fly strip's trailing end.

26. The method of claim 21, wherein said succeeding fly strip is driven through a clearance space between opposed surfaces, said clearance space being sized to prevent bunching of said succeeding fly strip when it abuts the preceding fly strip's trailing end.

27. Apparatus for automatically attaching successive fly strips to a continuous length slide fastener chain, comprising a sewing machine, means for feeding said slide fastener chain to said sewing machine for sewing onto said fly strips, means for commencing sewing of a preceding fly strip in said sewing machine, a feed station upstream of said sewing machine for delivering a succeeding fly strip towards said sewing machine, said feed station having a continuously operating drive means for conducting said succeeding fly strip through said feed station at a speed substantially faster than the rate of feed of said sewing machine until a leading end of said succeeding fly strip abuts the trailing end of said preceding fly strip as said preceding fly strip is being sewn and having a guide means for guiding said succeeding fly strip through said feed station, and means for passing successive fly strips consecutively to said feed station, such that the leading end of said succeeding fly strip does not overlap or bunch at said preceding fly strip trailing end upon abutting despite continuous operation of said drive means.

28. The apparatus of claim 27, further comprising means for shutting off said sewing machine in response to detecting a spatial gap at said sewing machine following the trailing end of said preceding fly strip being sewn.

29. The apparatus of claim 27, wherein said drive means comprises a series of driven conveyor means for consecutively moving said succeeding fly strip through said feed station, the rates of speed of said conveyor means being progressively slower at each further downstream conveyor means but always greater than the rate of feed of said sewing machine.

30. The apparaus of claim 29, wherein the rate of speed of said upstream-most conveyor means is about 40% greater than the rate of feed of said sewing machine.

31. The apparatus of claim 27, wherein said guide means comprises an edge wall against and along which a common side of each succeeding fly strip is moved by said drive means for aligning said successive fly strips during conduction through said feed station.

32. The apparatus of claim 31, wherein said guide means comprises a pair of opposed surfaces defining a clearance space therebetween through which said succeeding fly strip is conducted, said clearance space being sized to prevent bunching of said succeeding piece when it abuts the preceding fly strip's trailing end.

* * * * *